US009605566B2

(12) United States Patent
Neukirchner et al.

(10) Patent No.: US 9,605,566 B2
(45) Date of Patent: Mar. 28, 2017

(54) ADJUSTMENT SHAFT ACTUATOR FOR LIFT-SWITCHABLE VALVE TRAINS OF INTERNAL COMBUSTION ENGINES

(71) Applicant: IAV GMBH Ingenieurgesellschaft Auto und Verkehr, Berlin (DE)

(72) Inventors: Heiko Neukirchner, Chemnitz (DE); Andreas Werler, Zwickau (DE); Uwe Richter, Chemnitz (DE)

(73) Assignee: IAV GMBH INGENIEURGESELLSCHAFT AUTO UND VERKEHR, Berlin (DE)

( * ) Notice: Subject to any disclaimer, the term of this patent is extended or adjusted under 35 U.S.C. 154(b) by 0 days.

(21) Appl. No.: 14/876,841

(22) Filed: Oct. 7, 2015

(65) Prior Publication Data

US 2016/0102588 A1 Apr. 14, 2016

(30) Foreign Application Priority Data

Oct. 7, 2014 (DE) ..... 10 2014 014 598

(51) Int. Cl.
*F01L 1/34* (2006.01)
*F01L 13/00* (2006.01)
*F01L 1/047* (2006.01)

(52) U.S. Cl.
CPC ..... *F01L 13/0036* (2013.01); *F01L 1/047* (2013.01); *F01L 13/0042* (2013.01)

(58) Field of Classification Search
CPC .... F01L 1/047; F01L 13/0036; F01L 13/0042
USPC ..... 123/90.16, 90.18, 90.6
See application file for complete search history.

(56) References Cited

U.S. PATENT DOCUMENTS

| | | | | |
|---|---|---|---|---|
| 8,225,759 | B2 | 7/2012 | Wutzler et al. | |
| 8,347,837 | B2 | 1/2013 | Meintschel et al. | |
| 9,249,697 | B2 * | 2/2016 | Doller | F01L 13/0036 123/90.18 |
| 2012/0291731 | A1 | 11/2012 | Parsche | |

FOREIGN PATENT DOCUMENTS

| | | | |
|---|---|---|---|
| DE | 10148177 | A1 | 4/2003 |
| DE | 102008061440 | B3 | 6/2010 |
| DE | 102009057691 | A1 | 6/2011 |
| DE | 102011101868 | A1 | 11/2012 |
| DE | 102011115788 | A1 | 4/2013 |
| DE | 102012001303 | A1 | 7/2013 |
| WO | 2009065478 | A1 | 5/2009 |

* cited by examiner

*Primary Examiner* — Ching Chang
(74) *Attorney, Agent, or Firm* — Leydig, Voit & Mayer, Ltd.

(57) ABSTRACT

An adjustment shaft actuator. The adjustment shaft actuator includes an adjustment shaft arranged parallel to a camshaft of a valve train and having a lever unit with a lever arm, a cam unit that has a cam and that is connected to the camshaft in a non-rotatable manner, whereby the lever unit is arranged so as to be axially movable on the adjustment shaft or the cam unit is arranged so as to be axially movable on the camshaft, and an adjustment unit provided in order to effectuate axial movement between the at least one lever unit and the at least one cam unit, by way of which the at least one lever arm can be brought into effective contact with the cam in order to bring about a rotation of the adjustment shaft by rotating the camshaft.

4 Claims, 5 Drawing Sheets

ADJUSTMENT SHAFT ACTUATOR FOR LIFT-SWITCHABLE VALVE TRAINS OF INTERNAL COMBUSTION ENGINES

CROSS REFERENCE TO RELATED APPLICATIONS

This application claims benefit to German Patent Application No. DE 10 2014 014 598.0, filed Oct. 7, 2014, which is herein incorporated by reference.

FIELD

The present invention relates to an adjustment shaft actuator for lift-switchable valve trains of internal combustion engines.

BACKGROUND

Valve train devices are known that have a mechanism for switching over the lift of gas-exchange valves. Gas-exchange valves, especially the inlet and outlet valves of an internal combustion engine, can be actuated directly or indirectly by means of a camshaft. In order to switch over the valve lift, cams that are adjacent on the camshaft are provided with different cam shapes and are combined to form a cam unit. Due to an axial movement of the cam units on the camshaft, the lift of the gas-exchange valves is changed as a function of the cam contours. In order to move the cam units, an adjustment shaft is provided that runs parallel to the camshaft and that has corresponding elements for engagement with the axially movable components such as, for example, cam units. The adjustment shaft is rotatably mounted parallel to the camshaft in several shaft bearings in a housing. The housing can be a cylinder head, a ladder chassis, modules or other means for accommodating an adjustment shaft. At least one adjustment mechanism is mounted on the adjustment shaft and it is associated with a cam unit in order to directly or indirectly actuate gas-exchange valves.

German patent publication DE 10 2008 061 440 B3 describes a rotatable adjustment shaft which is arranged parallel to a camshaft and on which two adjustment means as well as between the adjustment means two catches are arranged in a torque-proof manner, whereby they can be moved axially on the adjustment shaft in order to switch over the valve between two different cam profiles of a cam package that can be moved axially on the camshaft. When the adjustment shaft is rotated, the catches are moved axially on the adjustment shaft, whereby the rotation is effectuated by the camshaft. For this purpose, there is a torque-proof but axially movable gear wheel that is arranged on the adjustment shaft, that serves to rotate the adjustment shaft, and that, by means of a drive arranged on the adjustment shaft, is made to engage with a tooth segment arranged on the camshaft.

German preliminary published application DE 10 2009 057 691 A1 discloses an adjustment shaft that is arranged parallel to a camshaft and that can be connected to the camshaft by means of an actuating gear, so that, when an effective engagement with the camshaft is established, the adjustment shaft is rotated by the camshaft, as a result of which a cam package provided with different cam profiles is moved axially on the camshaft by means of catches and a shift gate. The actuating gear according to the invention for connecting the camshaft to and disconnecting the camshaft from the adjustment shaft consists of a one-arm or multi-arm lever system and of a profiled gate part. The lever system is arranged securely on the adjustment shaft. The gate part is arranged so as to be torque-proof but axially movable on the camshaft, whereby it can be selectively engaged with and disengaged from the lever system by means of an actuator.

German preliminary published application DE 10 2011 115 788 A1 discloses an adjustment shaft actuator comprising a cam unit that has a cam and that is mounted on a camshaft in a torque-proof manner, and also comprising a lever unit that is mounted on an adjustment shaft in a torque-proof manner and that is in the form of a pivoted lever with a first lever arm and with an additional lever arm that is axially at a distance and angularly offset. As a function of the position of the cam unit and of the lever unit relative to each other, one of the lever arms is operatively connected to the cam, whereby, owing to the rotational movement of the camshaft, a pivoting movement is applied to the corresponding lever arm via the cam contour, and the adjustment shaft is rotated. Two rotational positions can be implemented by means of the adjustment shaft actuator.

SUMMARY

According to an embodiment, an adjustment shaft actuator with a reversal of the direction of rotation for lift-switchable valve trains of internal combustion engines is provided. The adjustment shaft actuator includes an adjustment shaft arranged parallel to a camshaft of a valve train and having at least one lever unit with at least one lever arm, at least one cam unit that has a cam and that is connected to the camshaft in a torque-proof manner, whereby at least one of the at least one lever unit is arranged so as to be axially movable on the adjustment shaft or the at least one cam unit is arranged so as to be axially movable on the camshaft, and at least one adjustment unit provided in order to effectuate axial movement between the at least one lever unit and the at least one cam unit, by way of which the at least one lever arm can be brought into effective contact with the cam in order to bring about a rotation of the adjustment shaft by rotating the camshaft. For purposes of an effective contact with the at least one lever arm, the cam includes a first partial contour that runs along a circumference of the cam, starting from a base circle and extending to a cam end contour, includes a first ascending course with an axial offset in the radial direction.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
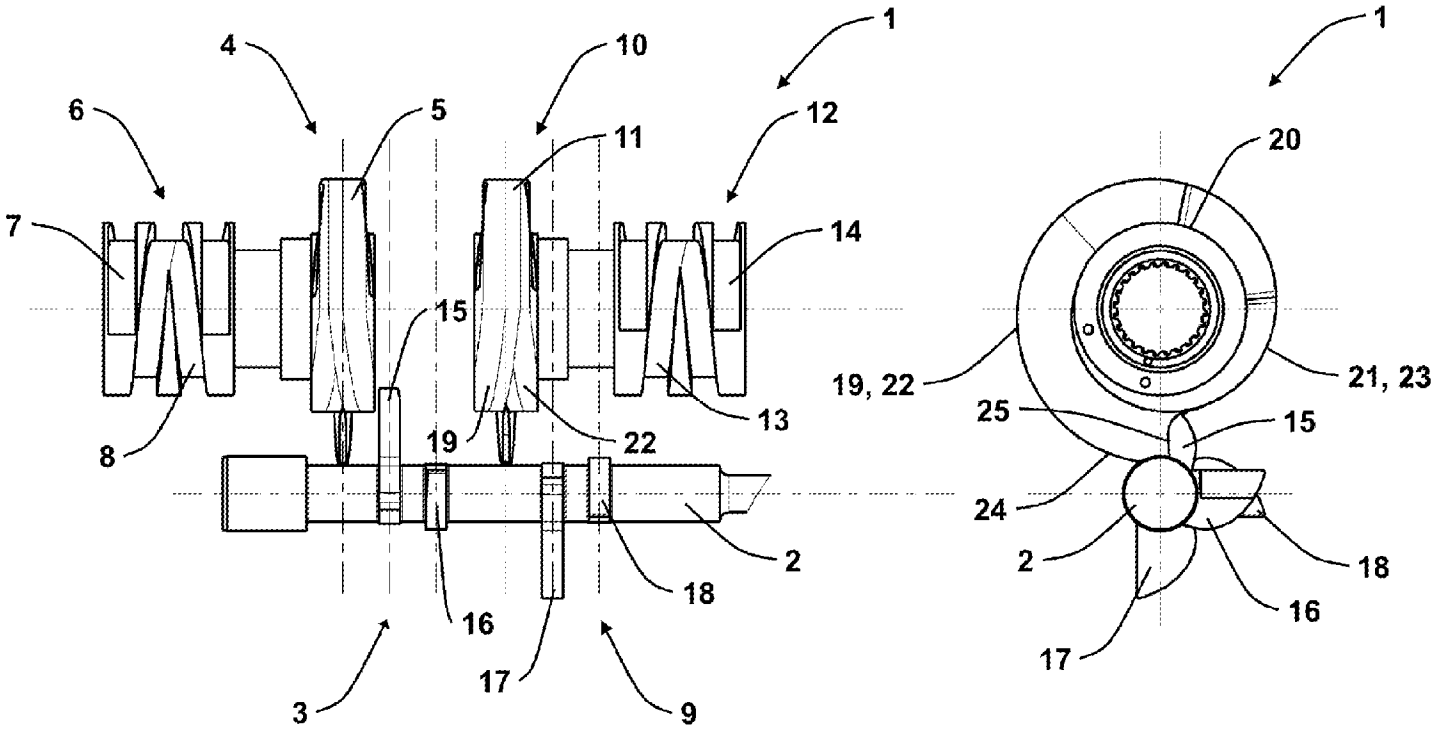
FIG. 1 is a schematic view of an adjustment shaft actuator in the starting position according to an embodiment of the invention.

An embodiment of the invention provides an improved adjustment shaft actuator for lift-switchable valve trains of internal combustion engines.

An embodiment of the invention provides an advantageous adjustment shaft actuator for lift-switchable valve trains of internal combustion engines, with which an adjustment shaft that belongs to a lift-switchable valve train and that is arranged parallel to a camshaft of the valve train can be rotated, whereby an incremental rotation of the adjustment shaft with several rotational positions can be attained. In an advantageous refinement of an embodiment of the invention, the direction of rotation of the adjustment shaft is reversed, whereby the adjustment shaft can be rotated by means of the camshaft in a first direction of rotation and in a second direction of rotation that is opposite from the first direction of rotation.

The adjustment shaft actuator according to an embodiment of the invention comprises at least one lever unit that is connected to the adjustment shaft in a torque-proof manner as well as at least one cam unit that is connected to the camshaft in a torque-proof manner. The lever unit and the cam unit are arranged so as to be axially movable relative to each other, whereby the lever unit is arranged so as to be axially movable on the adjustment shaft and/or the cam unit is arranged so as to be axially movable on the camshaft. An adjustment unit is provided in order to effectuate the axial movement, whereby the adjustment unit is connected to the lever unit when the lever unit is arranged so as to be axially movable on the adjustment shaft, or else the adjustment shaft unit is connected to the cam unit when the cam unit is arranged so as to be axially movable on the camshaft. The cam unit comprises a cam having a contour that, due to the axial movement between the cam unit and the lever unit, can be brought into effective contact with an effective surface of the lever arm in order to transmit a rotational movement of the camshaft to the adjustment shaft.

For the actuation of the lever arm by means of the cam at particularly low loads, in an advantageous manner according to an embodiment of the invention, the cam is provided with a first partial contour that runs along the circumference of the cam and that, starting from a base circle and extending to a cam end contour, has an ascending course with an axial offset in the radial direction. Adjoining the cam end contour, there is a descending course that is shorter than the ascending course and that extends all the way to the base circle. In an advantageous refinement according to an embodiment of the invention, in order to establish an effective contact at both sides of the cam, a second partial cam contour is provided that is axially adjacent to the first partial cam contour and that, starting from a base circle, has an ascending course with an axial offset in the radial direction. In this context, the ascending course of the first partial cam contour and the ascending course of the second partial cam contour are oriented in the same direction, and the axial offset of the first partial cam contour and the axial offset of the second partial cam contour are oriented opposite from each other, so that the first partial cam contour and the second partial cam contour, starting from the base circle, ascend with a rising course and make a transition into each other so as to form a shared cam end contour. Adjoining the cam end contour, there is a descending course that is shorter than the ascending course and that extends all the way to the base circle. Consequently, the cam has a radially ascending first partial cam contour that runs helically along the circumference of the cam, and it also has an equidirectional radially ascending second partial cam contour that runs helically opposite from the first partial cam contour, and the courses of both of these contours make a gradual transition into each other. In this manner, a cam contour is provided by means of which an effective contact can be established on both sides of the cam between the effective area of the lever arm and the cam contour. In an advantageous manner, the radially ascending course of the first partial cam contour and of the second partial cam contour extends at least over the entire circumference of the cam.

The effective contact between the effective area of the lever arm and the cam contour is established by the axial movement in the area of the base circle. During the rotation of the camshaft, the effective contact migrates over the course of the cam contour, whereby the axial movement is continued in order to compensate for the axial offset that is present in the course of the cam contour, so that the effective area of the lever arm always remains in effective contact with the cam contour.

In order to reverse the direction of rotation with at least two rotational positions, the adjustment shaft is connected to a first lever unit in a torque-proof manner and to a second lever unit. The first lever unit comprises at least one lever arm and the second lever unit comprises at least one additional lever arm that is at a distance from the lever arm axially and along the circumference of the adjustment shaft. Owing to the axial movement between the cam unit and the first lever unit as well as the second lever unit, the cam can be brought into effective contact with one of the lever arms in each case, in order to transmit a rotational movement of the camshaft to the adjustment shaft. The at least one lever arm of the first lever unit is configured to bring about a rotation of the adjustment shaft in the first direction of rotation, and the at least one additional lever arm of the second lever unit is configured to effectuate a rotation of the adjustment shaft in the second direction of rotation, whereby the at least one lever arm of the first lever unit and the at least one additional lever arm of the second lever unit are oriented opposite from each other in terms of the effective area needed for the effective contact between the appertaining lever arm and the cam. Moreover, the lever arms are arranged at a distance from each other along the circumference of the adjustment shaft in such a way that at least one of the lever arms is always oriented in the appertaining rotational position so that it can be brought into effective contact with the cam of the cam unit.

The adjustment shaft is rotated in the first direction of rotation in that the cam is brought into effective contact with the at least one lever arm of the first lever unit and, owing to the rotation of the camshaft, the adjustment shaft is moved out of a first rotational position and into a second rotational position, and furthermore, the at least one additional lever arm of the second lever unit is oriented for a subsequent effective contact with the cam. The adjustment shaft is rotated in the second direction of rotation in that the cam is brought into effective contact with the oriented, at least one additional lever arm of the second lever unit, and, owing to the rotation of the camshaft, the adjustment shaft is moved out of the second rotational position and into the first rotational position, and furthermore, the at least one lever arm of the first lever unit is oriented for a subsequent effective contact with the cam.

The adjustment unit comprises a first guide path that runs helically along the circumference of the adjustment unit that is configured as a sleeve, and it also comprises a second guide path that runs helically opposite from the first guide path at an axial distance. Consequently, the first guide path and the second guide path, which is axially at a distance from the first guide path, run along the circumference of the adjustment unit, and they have an axial offset, whereby the axial offset of the first guide path and the axial offset of the second guide path are oriented opposite from each other. As a function of the direction of the course along the first guide path and the second guide path, the axial distance between the first guide path and the second guide path decreases or increases. Here, the first guide path and the second guide path run at least over the entire circumference. In order to attain a compact design, the first guide path and the second guide path can have a shared overlapping area.

Furthermore, a first actuator can be selectively brought into effective contact with the first guide path when the cam unit and the first lever unit as well as the second lever unit are to be moved axially towards each other in a first direction, and a second actuator can be selectively brought into effective contact with the second guide path when the cam unit and the first lever unit as well as the second lever unit are to be moved axially towards each other in a second direction that is opposite from the first direction.

In order to achieve an advantageous refinement for providing at least four rotational positions, the first lever unit comprises a first lever arm and a second lever arm that is at a distance from the first lever arm axially and along the circumference of the adjustment shaft. The second lever unit comprises a third lever arm that is at a distance from the first lever arm and from the second lever arm axially and along the circumference of the adjustment shaft, as well as a fourth lever arm that is at a distance from the first lever arm, from the second lever arm, and from the third lever arm axially and along the circumference of the adjustment shaft. Accordingly, two lever units each having two lever arms are connected to the adjustment shaft in a torque-proof manner, whereby the four lever arms are arranged axially and at a distance from each other along the circumference of the adjustment shaft. In a special embodiment, three of the at least four lever arms are at a distance from each other along the circumference of the adjustment shaft at an angle of 90°, and two of the at least four lever arms are not at a distance from each other along the circumference of the adjustment shaft.

The first lever arm and the second lever arm of the first lever unit are configured to rotate the adjustment shaft in the first direction of rotation. The third lever arm and the fourth lever arm are configured to rotate the adjustment shaft in the second direction of rotation. For this purpose, the first lever arm and the second lever arm of the first lever unit are oriented in the same direction with respect to the effective area needed for the effective contact. Moreover, for this purpose, the third lever arm and the fourth lever arm of the second lever unit in terms of the effective area needed for the effective contact are oriented in the opposite direction relative to the effective areas of the first lever arm and of the second lever arm. Moreover, the four lever arms are arranged at a distance from each other along the circumference of the adjustment shaft in such a way that at least one of the four lever arms is always oriented so that it can be brought into effective contact with the cam of the cam unit. Owing to the arrangement of the four lever arms, it is possible to effectuate an incremental rotation of the adjustment shaft in the first direction of rotation and in the second direction of rotation.

If one of the four lever arms of the two lever units is brought into effective contact with the cam of the cam unit, then the specific lever arm of the appertaining lever unit is supported on the cam contour. Via the effective contact between the cam and one of the four lever arms, the rotational movement of the camshaft is transmitted to the adjustment shaft, a process in which, owing to the rotation of the adjustment shaft, at least one other of the four lever arms is oriented and can be brought into effective contact with the cam. Once the rotational movement of the adjustment shaft has been completed, the effective contact used for the completed rotational movement that follows the course of the cam contour is eliminated and at least one other of the four lever arms is oriented for an effective contact with the cam.

The adjustment shaft is rotated in the first direction of rotation in that the cam is brought into effective contact with the oriented first lever arm and, owing to the rotation of the camshaft, the adjustment shaft is moved out of a first rotational position and into a second rotational position, and furthermore, the second lever arm as well as the third lever arm are oriented for a subsequent effective contact with the cam, or else the cam is brought into effective contact with the oriented second lever arm and, owing to the rotation of the camshaft, the adjustment shaft is moved out of a second rotational position into a third rotational position, and moreover, the fourth lever arm is oriented for a subsequent effective contact with the cam.

The adjustment shaft is rotated in the second direction of rotation in that the cam is brought into effective contact with the oriented third lever arm and, owing to the rotation of the camshaft, the adjustment shaft is moved out of the second rotational position and into the first rotational position, and furthermore, the first lever arm is oriented for a subsequent effective contact with the cam, or else the cam is brought into effective contact with the oriented fourth lever arm and, owing to the rotation of the camshaft, the adjustment shaft is moved out of a third rotational position into a second rotational position, and moreover, the second lever arm as well as the third lever arm are oriented for a subsequent effective contact with the cam. For purposes of attaining an effective contact of the cam with the first lever arm, the second lever arm, the third lever arm or the fourth lever arm, the cam and each lever arm that can be brought into effective contact with the cam are all oriented relative to each other by means of the adjustment unit.

In an advantageous manner, the cam unit is mounted on the camshaft so as to be axially movable and it is connected to the adjustment unit for purposes of the axial movement.

In an especially advantageous refinement, two cam units are each provided with an adjustment unit, whereby a first cam unit is associated with a first cam and with a first adjustment unit of the first lever unit, and a second cam unit is associated with a second cam and with a second adjustment unit of the second lever unit. Accordingly, the first cam can be brought into effective contact with the first lever arm or with the second lever arm by means of the first adjustment unit, while the second cam can be brought into effective contact with the third lever arm or with the fourth lever arm by means of the second adjustment unit.

Figure 2:
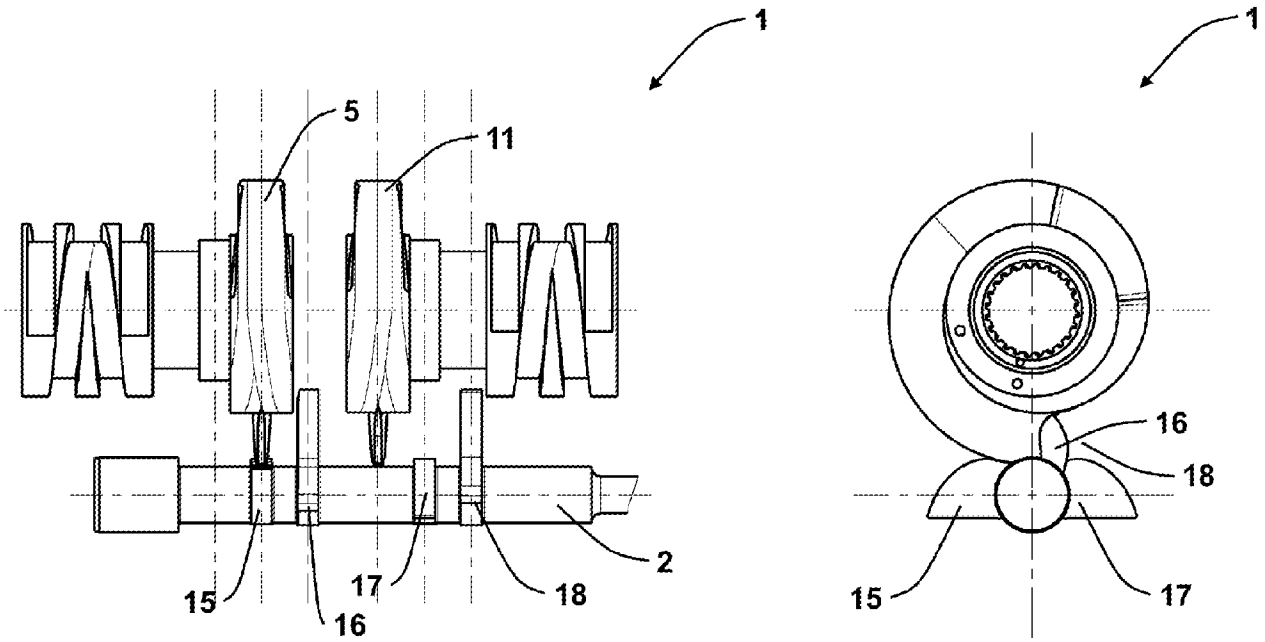
FIG. 2 is a schematic view of the adjustment shaft actuator in a first switching position according to an embodiment of the invention.
Figure 3:
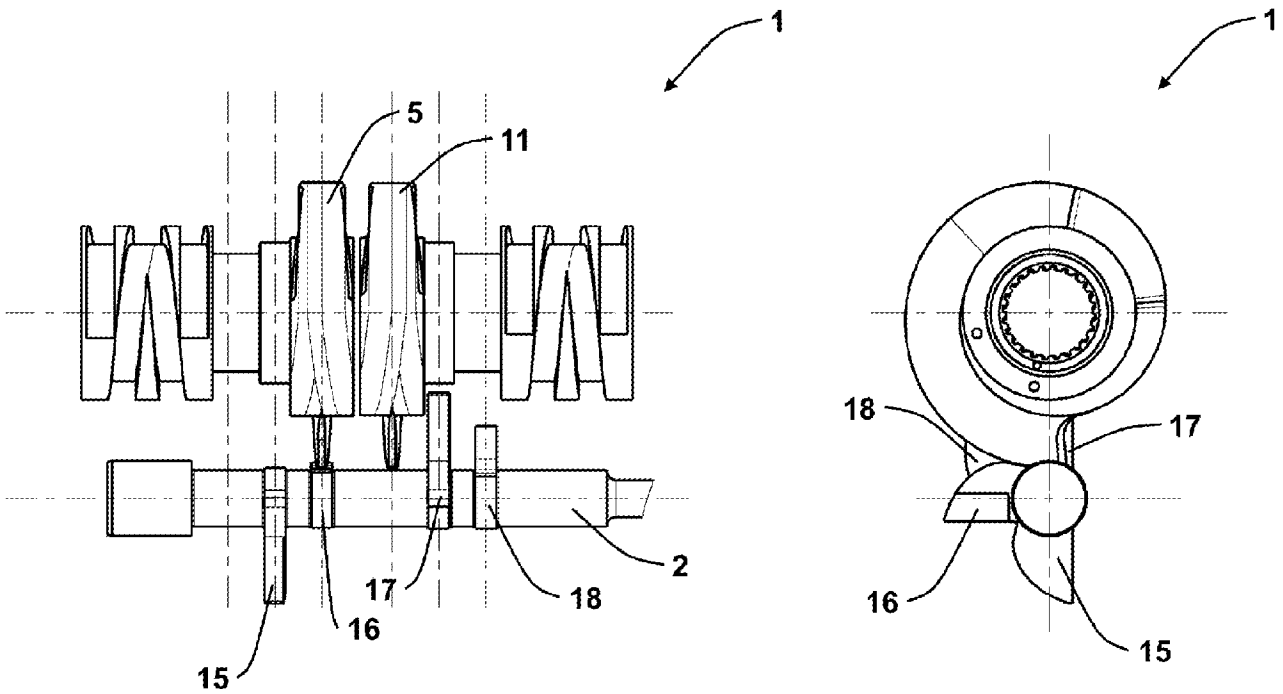
FIG. 3 is a schematic view of the adjustment shaft actuator in a second switching position according to an embodiment of the invention.
Figure 4:
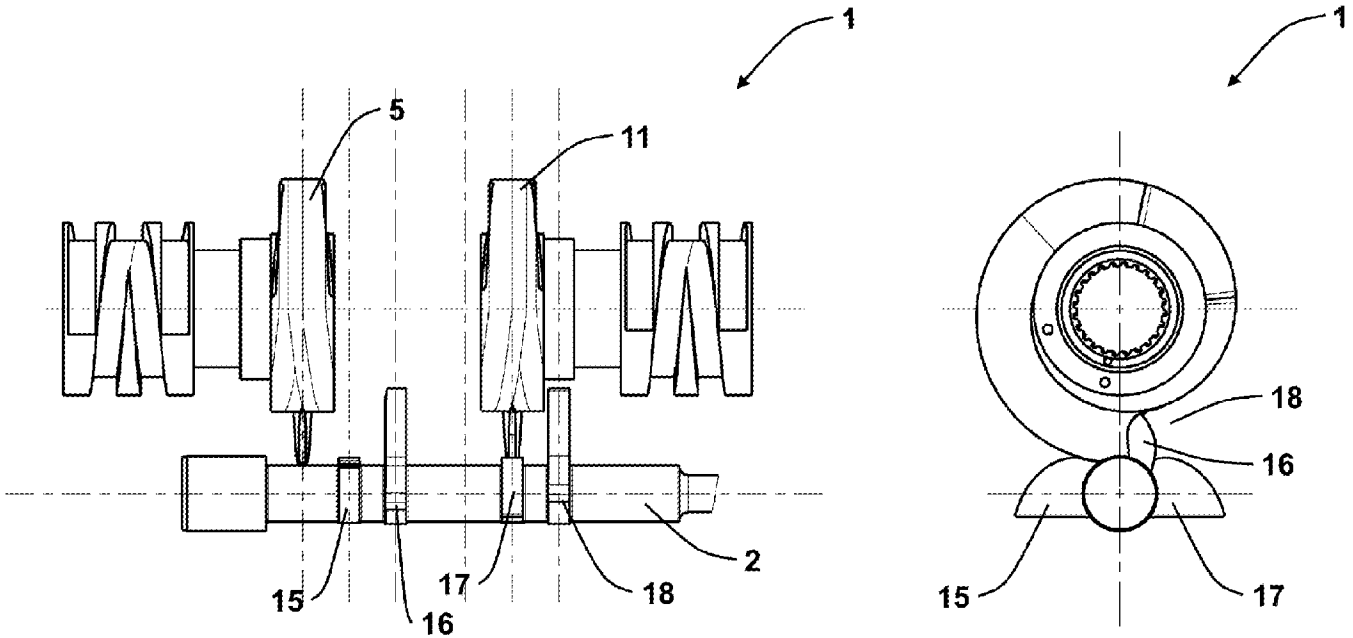
FIG. 4 is a schematic view of the adjustment shaft actuator in a third switching position according to an embodiment of the invention.
Figure 5:
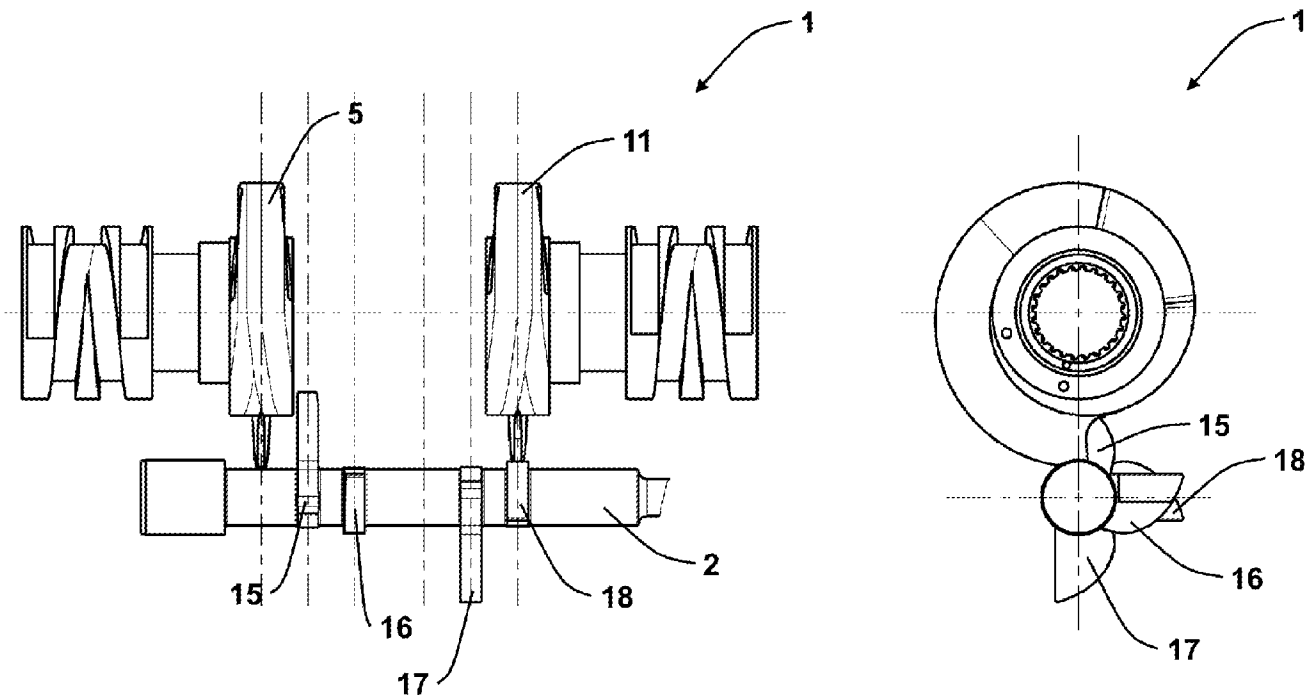
FIG. 5 is a schematic view of the adjustment shaft actuator in a fourth switching position according to an embodiment of the invention.

The adjustment shaft actuator 1 according to an embodiment of the invention, shown in FIGS. 1 to 5, consists of an adjustment shaft 2 comprising a first lever unit 3, with which a first cam unit 4 having a first cam 5 and a first adjustment unit 6 having a first guide path 7 and a second guide path 8 are associated, and comprising a second lever unit 9, with which a second cam unit 10 having a second cam 11 and a second adjustment unit 12 having a third guide path 13 and a fourth guide path 14 are associated.

The first cam unit 4 is mounted on a camshaft (not shown here) so as to be torque-proof but axially movable, and it is connected to the first adjustment unit 6 for purposes of the axial movement relative to the first lever unit 3. The second cam unit 10 is mounted on the camshaft (not shown here) so as to be torque-proof but axially movable and it is connected to the second adjustment unit 12 for purposes of the axial movement relative to the second lever unit 9.

The first lever unit 3 comprises a first lever arm 15 and a second lever arm 16 that is at a distance from the first lever arm axially and along the circumference of the adjustment shaft 2, whereby the first lever unit 3 is mounted on the adjustment shaft 2 in a torque-proof manner. The second lever unit 9 comprises a third lever arm 17 that is at a distance from the first lever arm 15 and from the second lever arm 16 axially and along the circumference of the adjustment shaft 2, and it also comprises a fourth lever arm 18 that is at a distance from the first lever arm 15, from the second lever arm 16, and from the third lever arm 17 axially and along the circumference of the adjustment shaft 2, whereby the second lever unit 9 is mounted on the adjustment shaft 3 in a torque-proof manner.

The first cam 5 can be brought into effective contact with the first lever arm 15 or with the second lever arm 16 by means of the first adjustment unit 6, while the second cam 11 can be brought into effective contact with the third lever arm 17 or with the fourth lever arm 18 by means of the second adjustment unit 12.

In terms of their effective area, the first lever arm 15 and the second lever arm 16 are oriented in the same direction as the first cam 5 in order to effectuate a rotation of the adjustment shaft 3 in a first direction of rotation. In terms of their effective area with the second cam 11, the third lever arm 17 and the fourth lever arm 18 are oriented in the opposite direction relative to the effective areas of the first lever arm 15 and of the second lever arm 16 in order to effectuate a rotation of the adjustment shaft 3 in a second direction of rotation that is opposite from the first direction of rotation.

The first cam 5 and the second cam 11 are each provided with a first partial cam contour 19 that runs along the circumference of the particular cam and that, starting from a base circle 20, has a first ascending course 21 with an axial offset in the radial direction. Furthermore, a second partial cam contour 22 is provided that is adjacent to the first partial cam contour 19 and that, starting from the base circle 20, has a second ascending course 23 with an axial offset in the radial direction. Here, the first ascending course 21 and the second ascending course 23 are oriented in the same direction and the axial offset of the first partial cam contour 19 and of the second partial cam contour 22 are oriented opposite from each other, so that the first partial cam contour 19 and the second partial cam contour 22, starting from the base circle 20, ascend with a rising course and make a transition into each other so as to form a shared cam end contour 24. Adjoining the cam end contour 24, there is a descending course 25 that is shorter than the ascending course and that extends all the way to the base circle 20.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF THE REFERENCE NUMERALS EMPLOYED

1 adjustment shaft actuator
2 adjustment shaft
3 first lever unit
4 first cam unit
5 first cam
6 first adjustment unit
7 first guide path
8 second guide path
9 second lever unit
10 second cam unit
11 second cam
12 second adjustment unit
13 third guide path
14 fourth guide path
15 first lever arm
16 second lever arm
17 third lever arm
18 fourth lever arm
19 first partial cam contour
20 base circle
21 first ascending course
22 second partial cam contour
23 second ascending course
24 cam end contour
25 descending course

The invention claimed is:

1. An adjustment shaft actuator with a reversal of the direction of rotation for lift-switchable valve trains of internal combustion engines, comprising:

an adjustment shaft arranged parallel to a camshaft of a valve train and having at least one lever unit with at least one lever arm;

at least one cam unit that has a cam and that is connected to the camshaft in a non-rotatable manner, whereby the at least one lever unit is arranged so as to be axially movable on the adjustment shaft or the at least one cam unit is arranged so as to be axially movable on the camshaft;

and at least one adjustment unit provided in order to effectuate axial movement between the at least one lever unit and the at least one cam unit, by way of which the at least one lever arm can be brought into effective contact with the cam in order to bring about a rotation of the adjustment shaft by rotating the cam-shaft, wherein, for purposes of an effective contact with the at least one lever arm, the cam includes a first partial contour that runs along a circumference of the cam, starting from a base circle and extending to a cam end contour, includes a first ascending course with an axial offset in the radial direction.

2. The adjustment shaft actuator according to claim 1, wherein the cam also has a second partial cam contour that is adjacent to the first partial cam contour and that runs along the circumference of the cam and that, starting from the base circle, includes a second ascending course with an axial offset in a radial direction, wherein the first ascending course and the second ascending course are oriented in the same direction, and the axial offset of the first partial cam contour and the axial offset of the second partial cam contour are oriented opposite from each other, so that the first partial cam contour and the second partial cam contour, starting from the base circle, ascend with a rising course all the way to cam end contour and make a transition into each other.

3. The adjustment shaft actuator according to claim 1, wherein a lever unit connected to the adjustment shaft in a non-rotatable manner and a second lever unit connected to the adjustment shaft in a non-rotatable manner are provided, wherein the first lever unit comprises a first lever arm and the second lever unit comprises a second lever arm that is at a distance from the first lever arm axially and along the circumference of the adjustment shaft, and wherein the first lever arm of the first lever unit and the second lever arm of the second lever unit are oriented opposite from each other in terms of an effective area needed for effective contact between an appertaining lever arm and the cam.

4. The adjustment shaft actuator according to claim 1, wherein a course of the first partial contour extends at least over the entire circumference of the cam.

* * * * *